US006957704B2

(12) United States Patent
Rogers et al.

(10) Patent No.: US 6,957,704 B2
(45) Date of Patent: Oct. 25, 2005

(54) LIMIT CLAMP FOR USE WITH CASING ATTACHMENTS

(75) Inventors: Henry E. Rogers, Duncan, OK (US); Earl D. Webb, Wilson, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 196 days.

(21) Appl. No.: 10/438,367

(22) Filed: May 14, 2003

(65) Prior Publication Data

US 2004/0226714 A1 Nov. 18, 2004

(51) Int. Cl.[7] ..... E21B 17/10
(52) U.S. Cl. ..... 166/378; 166/241.7; 166/381
(58) Field of Search ..... 166/277, 378, 166/381, 172, 180, 241.1, 241.2, 241.6, 241.7

(56) References Cited

U.S. PATENT DOCUMENTS

| | | | | |
|---|---|---|---|---|
| 1,314,070 | A | 8/1919 | McKissick | |
| 1,767,198 | A | 6/1930 | Baker | |
| 2,058,310 | A | 10/1936 | Hartman et al. | |
| 2,546,582 | A | 3/1951 | Baker | |
| 2,628,682 | A | 2/1953 | Wright | |
| 2,640,544 | A | 6/1953 | Baker | |
| 2,666,241 | A | 1/1954 | Hall, Sr. | |
| 2,718,266 | A | 9/1955 | Berry et al. | |
| 2,727,576 | A | 12/1955 | Hall | |
| 2,738,019 | A | 3/1956 | Atkinson | |
| 2,812,200 | A | 11/1957 | Yeargan | |
| 2,824,613 | A | 2/1958 | Baker et al. | |
| 2,828,824 | A | 4/1958 | Comstock | |
| 2,832,421 | A | 4/1958 | Baker | |
| 2,846,016 | A | 8/1958 | Hanes | |
| 2,871,950 | A | 2/1959 | Baker | |
| 2,877,062 | A | 3/1959 | Hall et al. | |
| 2,898,136 | A | 8/1959 | Hall, Sr. et al. | |
| 2,962,313 | A | 11/1960 | Conrad | |
| 2,986,417 | A | 5/1961 | Baker | |
| 3,065,005 | A | 11/1962 | Hall, Sr. et al. | |
| 3,072,195 | A | 1/1963 | Kluck | |
| 3,172,475 | A | 3/1965 | Moore | 166/172 |
| 3,196,951 | A | 7/1965 | Sauernman | 166/241 |
| 3,200,884 | A | 8/1965 | Solum et al. | 166/241 |
| 3,235,295 | A | 2/1966 | Solum | 287/52 |
| 3,360,846 | A | 1/1968 | Schellstede et al. | 29/447 |
| 3,578,084 | A | 5/1971 | Bombardieri et al. | 166/288 |
| 3,614,139 | A | 10/1971 | Harrison | 287/52 |
| 4,021,083 | A | 5/1977 | Anderson | 308/4 A |
| 4,031,969 | A * | 6/1977 | Cullen et al. | 175/65 |
| 4,105,262 | A | 8/1978 | Richey | 608/4 A |

(Continued)

FOREIGN PATENT DOCUMENTS

| | | | |
|---|---|---|---|
| DE | 89 03 038.9 | 5/1989 | E21B 33/136 |

(Continued)

OTHER PUBLICATIONS

Foreign communication from a related counterpart application dated Jul. 5, 2004.

*Primary Examiner*—Zakiya Walker
(74) *Attorney, Agent, or Firm*—John W. Wustenberg; Baker Botts LLP

(57) ABSTRACT

A limit clamp for securing a tool to a casing having a groove in its outer surface. The limit clamp comprises a block having a base and a flange. The base is positioned in the groove to contact at least one stop in the groove and the flange extends out of the groove. The limit clamp also comprise a lock ring encircling the block and the casing, wherein the lock ring engages the block.

38 Claims, 10 Drawing Sheets

U.S. PATENT DOCUMENTS

| | | | | |
|---|---|---|---|---|
| 4,219,081 | A | 8/1980 | Howe | 166/241 |
| 5,238,062 | A | 8/1993 | Reinholdt | 166/241.7 |
| 5,695,297 | A | 12/1997 | Geib | 403/371 |
| 5,810,100 | A | 9/1998 | Samford | 175/325.3 |
| 5,823,273 | A | 10/1998 | Ravi et al. | 175/72 |
| 2002/0139537 | A1 | 10/2002 | Young et al. | 166/378 |
| 2003/0000607 | A1 | 1/2003 | Jenner | 148/652 |

FOREIGN PATENT DOCUMENTS

| | | | | |
|---|---|---|---|---|
| FR | 1.341.554 | | 9/1963 | |
| GB | 872345 | | 5/1961 | |
| GB | 917289 | | 1/1963 | |
| GB | 2 005 750 | A | 4/1979 | E21B 17/10 |
| GB | 2 396 172 | A | 6/2004 | E21B 17/10 |

* cited by examiner

LIMIT CLAMP FOR USE WITH CASING ATTACHMENTS

BACKGROUND

This invention relates to devices for attaching downhole tools to pipe, tubing, casing, or the like. In particular, the invention relates to a stop collar or limit clamp.

Downhole tools such as centralizers are typically attached to casing by a stop collar or, limit clamp. Stop collars or limit clamps have taken on many styles including: hinged friction collar, hinged collar with set screw, hinged collar with dogs, and slip collar with set screws.

The hinged collar has two semicircular bands which are joined at one end by a hinge. At the opposite ends from the hinge, the semicircular bands have a flange through which a bolt extends between the two flanges. Thus, the hinged style stop collar is attached to a pipe by spreading the semicircular bands wide enough to receive the pipe. Rotating about the hinge, the semicircular bands are close together until the flanges are proximate one another. A bolt is then inserted through the flanges and tightened. As the bolt tightens, the flanges are drawn closer together so as to squeeze the collar about the pipe.

The hinged collar with set screws also comprises two semicircular bands which together surround a pipe. In this case, however, both ends of both semicircular bands have a hinge. The hinge is made up of corresponding eyelet pieces which are joined by a pin. Thus, the collar is attached to a pipe by placing the semicircular bands on opposite sides of the pipe and mating the hinge eyelets at the ends of the bands. With the hinge eyelets properly mated, pins are inserted into the eyelets. The semicircular bands also comprise set screws which are used to tighten the collar on the pipe. The set screws extend in a radial direction through the bands toward the pipe. Any number of set screws may be used to secure the collar to the pipe, but six set screws equidistant from each other is typical.

Hinged collars with dogs are again made of two semicircular bands which mate with each other to extend about the circumference of a pipe. Rather than eyelets, two ends of the semicircular bands are joined by interlocking fingers. The opposite ends of the bands have flanges through which a bolt extends. As with the hinged style collar, as the bolt is tightened, the flanges are drawn closer together so as to squeeze the bands around the circumference of the pipe. This collar also has several dogs which extend radially through the bands to provide protrusions or bulges on the interior of the bands for engagement with the casing. As the bolt is tightened and the bands are squeezed about the circumference of the pipe, the dogs firmly engage the outer surface of the pipe.

Slip on collars with set screws are made of a single circular band, rather than two semicircular bands. This circular band is slipped over the end of a pipe and moved longitudinally along the pipe to the position at which it is to be secured to the pipe. Once the correct position is achieved, set screws which extend radially through the band are screwed inwardly toward the pipe until they firmly secure the collar to the pipe. Any number of set screws may be used with a slip on collar but 5–6 set screws equidistant from each other are typical.

A primary application for stop collars or limit clamps is to secure dual-ring centralizers, single-ring centralizers (bow spring and rigid) or other casing attachments to casing outside surfaces. In particular, flushline casing centralizers are connected to the casing by these type stop collars.

Centralizers typically comprise two rings connected to each other by bow springs. With each of the stop collar or limit clamp designs noted above, there is a minimum required gap between the casing outside diameter and the hole inside diameter. Typical stop collar configurations have the following holding capacities and outside diameters (OD) on the noted pipe sizes:

- 4½–17,778 pounds force with a positive OD of 6.00 inches.
- 5½–24,941 pounds force with a positive OD of 7.00 inches.
- 7–35,000 pounds force with a positive OD of 8.50 inches.
- 9⅝–39,000 pounds force with a positive OD of 11.125 inches.

In slim hole casing programs, the gap between the OD of the centralizer and the inside diameter of the wellbore is generally near 0.375 inches–0.625 inches per side. Where the stop collar is in the middle of a dual-ring, bow spring centralizer, the thickness of the bow spring must also be added to each side to determine the actual minimum restrictions through which a dual-ring centralizer must pass. Smaller gap restrictions have led to the increased use of integral rigid centralizer subs which do not require limit clamps at all. Flushline casing connections, in particular, present annulus gap sizes too small for conventional stop collars or limit clamps.

SUMMARY

The invention provides a method of retaining casing attachments to the casing outside surface with a thickness no greater than the rings of the casing attachments.

One aspect of the invention provides a method of securing a tool to a pipe, the method comprising: forming a groove in an exterior surface of the pipe, wherein the groove comprises a bottom and at least one stop; positioning a block in the groove so that a base of the block fits in the groove to contact the at least one stop and a flange of the block extends out of the groove; locking the block in the groove with a lock ring which encircles the block and the pipe and engages the block; and mounting the tool on the pipe so as to be retained by a member of a group consisting of the block and the lock ring.

According to another aspect of the invention, there is provided a limit clamp for securing a tool to pipe, the limit clamp comprising: a groove in an outer surface of the pipe comprising a bottom and at least one stop; a block comprising a base positioned in the groove to contact the at least one stop and a flange which extends out of the groove; and a lock ring encircling the block and the pipe, wherein the lock ring engages the block.

Another aspect of the invention provides a centralizer for a pipe within a borehole, the centralizer comprising: at least one ring larger than the outside diameter of the pipe; a plurality of bows connected to the at least one ring; a limit clamp connectable with the pipe for engaging the at least one ring, wherein the limit clamp comprises: a groove in an outer surface of the pipe comprising a bottom and at least one stop; a block comprising a base positioned in the groove to contact the at least one stop and a flange which extends out of the groove; and a lock ring encircling the block and the pipe, wherein the lock ring engages the block.

According to still another aspect of the invention, there is provided a centralizer sub comprising: a pipe; a groove in an exterior surface of the pipe, wherein the groove comprises a bottom and at least one stop; a block comprising a base which fits in the groove to contact the at least one stop and a flange which extends out of the groove; a lock ring encircling the block and the pipe and engaging the block; and a centralizer mounted to the pipe and retained by a member of a group consisting of the block and the lock ring.

The objects, features, and advantages of the present invention will be readily apparent to those skilled in the art upon a reading of the description of the preferred embodiments which follows.

BRIEF DESCRIPTION OF THE FIGURES

The present invention is better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
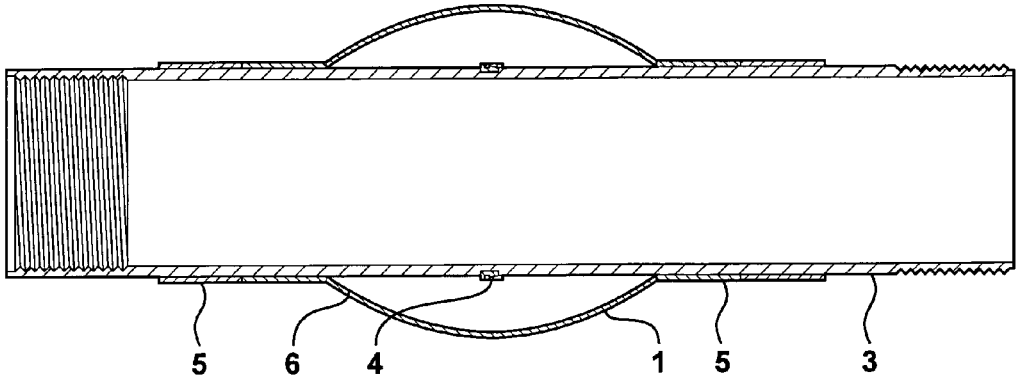
FIG. 1 is a side view of a dual-ring centralizer attached to a threaded sub by a limit clamp.

Referring to FIG. 1, a cross-sectional side view of a dual-ring centralizer 1 is shown attached to a sub 3 by a limit clamp 4. The sub 3 has male and female threads at opposite ends of the sub 3, respectively. The dual-ring centralizer 1 is made up of two rings 5 which are connected to each other by several bows 6. While the bows 6 illustrated are spring bows, the bows 6 may be spring bows or rigid bows. The rings 5 have inside diameters greater than the outside diameter of the sub 3. Thus, the rings 5 are free to slide longitudinally along the sub 3. The bows 6 connect the rings 5 to each other and insure that the rings 5 are separated from each other by a variable distance. The separation distance between the rings 5 varies as the bows 6 are squeezed radially inward toward the sub 3. The dual-ring centralizer 1 is limited in its ability to slide longitudinally along the sub 3 by the limit clamp 4. The limit clamp 4 is attached to the sub 3 at a position between the rings 5. Thus, as the dual-ring centralizer 1 moves in one longitudinal direction, its movement is limited by engagement of a ring 5 with the limit clamp 4. Similarly, movement of the dual-ring centralizer 1 in the opposite longitudinal direction is limited by engagement of the other ring 5 with the limit clamp 4. Thus, the limit clamp 4 allows the dual-ring centralizer 1 complete freedom to rotate about the sub 3, but it limits its ability to move longitudinally along the sub 3 to a distance approximately equal to the distance between the rings 5. The dual-ring centralizer sub shown in FIG. 1 may be assembled and distributed as a single unit for threadable assembly to a pipe string on site.

Figure 2:
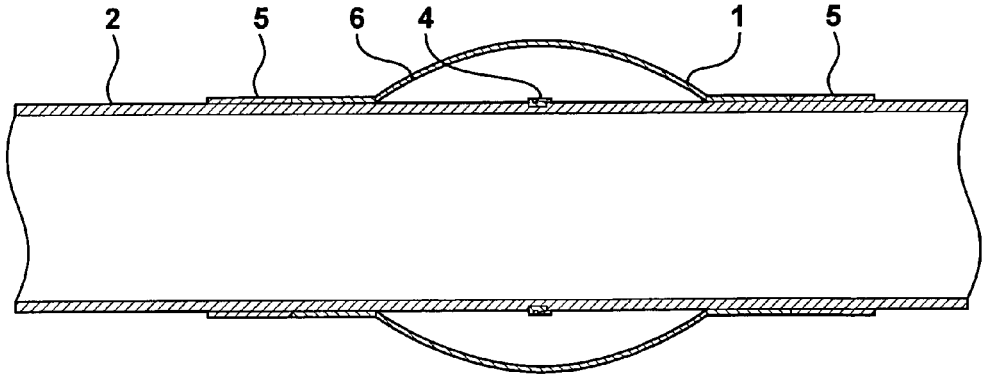
FIG. 2 is a side view of a dual-ring centralizer attached to a section of pipe by a limit clamp.

FIG. 2 is a cross-sectional side view of a dual-ring centralizer 1 attached to a pipe 2. Similar to the embodiment shown in FIG. 1, the dual-ring centralizer 1 is attached to the pipe 2 by a limit clamp 4.

Figure 3:
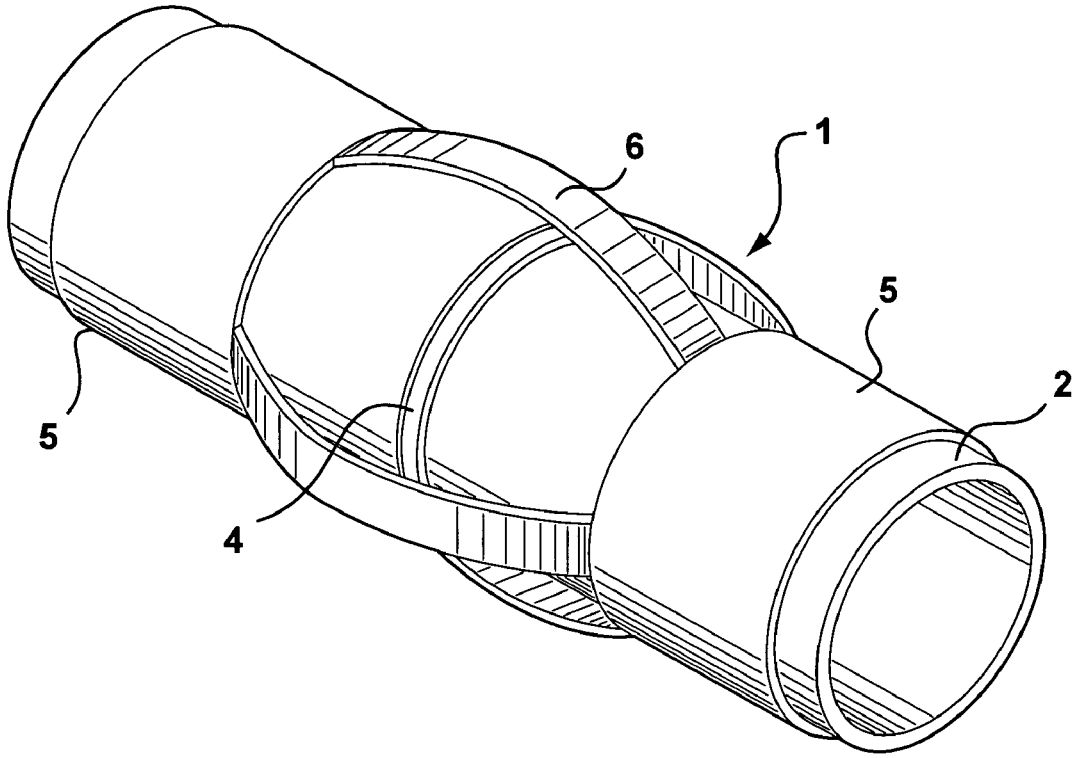
FIG. 3 is a perspective view of a dual-ring centralizer attached to a pipe section by a limit clamp.

Referring to FIG. 3, a perspective view of the pipe 2 and dual-ring centralizer 1 as illustrated in FIG. 2 is shown. This particular dual-ring centralizer 1 has four bows 6 which connect the rings 5 to each other. As discussed above, the limit clamp 4 is connected to the pipe 2 at a position between the rings 5 so as to limit longitudinal movement of the dual-ring centralizer 1.

Figure 4:
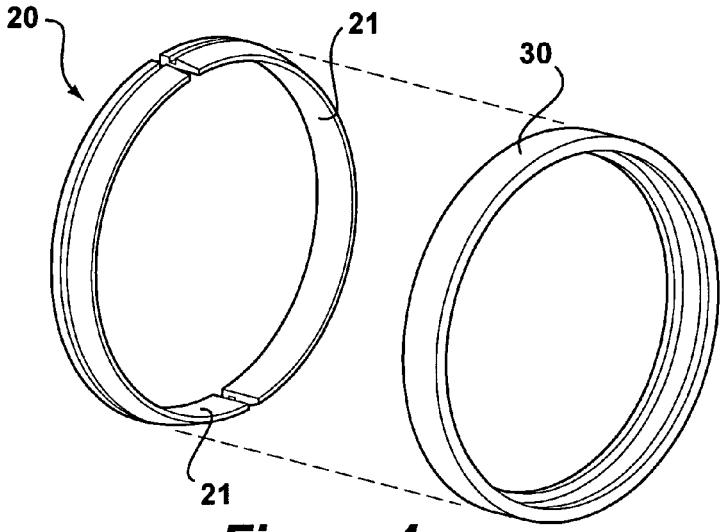
FIG. 4 is an exploded view of a block made of two semicircular bands and lock ring of a limit clamp.

Referring to FIG. 4, an exploded view of a block and a lock ring of a limit clamp is shown. In this particular embodiment, a block 20 comprises two semicircular bands 21. The semicircular bands 21 are positioned opposite one another to form a ring. The semicircular bands 21 snap into a lock ring 30, as described more fully below.

Figure 5:
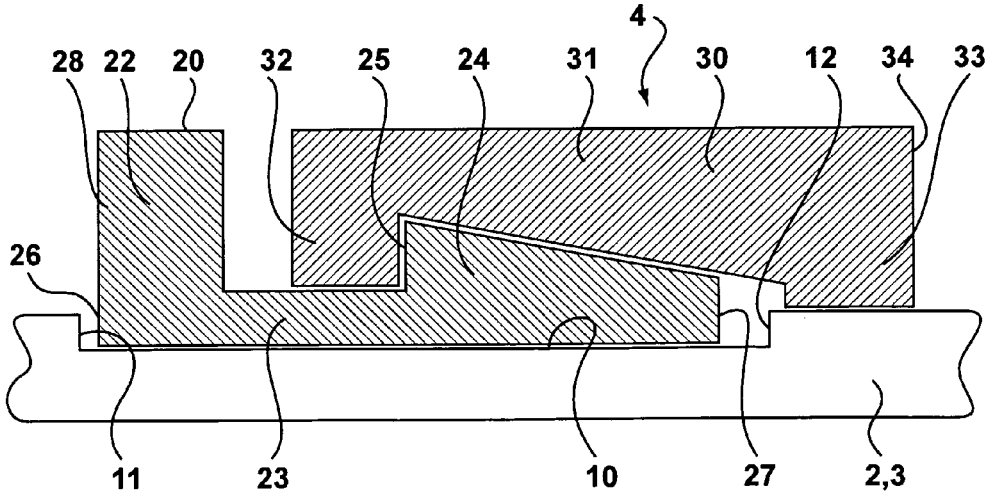
FIG. 5 is a cross-sectional side view of a limit clamp having a block positioned in a groove and a lock ring around the block. The block has a ramp and a load bearing flange. The lock ring has a lock flange and a slide block.

Referring to FIG. 5, a cross-sectional side view of a block, a lock ring, and a groove of a limit clamp are shown. A pipe or sub 2, 3 has a groove 10 formed in its outside surface. A block 20 is positioned in the groove 10. A lock ring 30 is positioned over the block 20 to secure the block 20 in the groove 10. The block 20 has a base 23 dimensioned so as to fit into the groove 10 in the pipe or sub 2, 3. A load bearing flange 22 extends radially outward from the base 23. A ramp 24 also extends radially outward from the base 23. The load bearing flange 22 and the ramp 24 are located at opposite ends of the base 23. The ramp 24 is configured so that the wedge block 20 is smallest at the distal end and taller towards its middle section. The ramp 24 is further configured to have a radial wall 25 extending from the highest point on the ramp 24 to the base 23.

As shown in FIG. 5, the groove 10 has stops 11 and 12 at opposite ends. In the embodiment shown, the stops 11 and 12 comprise walls which are perpendicular to the longitudinal central axis of the pipe or sub 2, 3. The block 20 has end walls 26 and 27 to engage stops 11 and 12, respectively. The stops 11 and 12 prevent the block 20 from moving in the longitudinal direction along the pipe or sub 2, 3.

The lock ring 30 is also illustrated in FIG. 5. The lock ring 30 has an annular band 31. At one end of the annular band 31, a lock flange 32 extends in a radial inward direction from the annular band 31. At the opposite end of the annular band 31, the lock ring 30 has a slide block 33 which extends in a radially inward direction from the annular band 31. The slide block 33 has a cylindrical inside surface which encircles the outside surface of the pipe or sub 2, 3.

The limit clamp 4 illustrated by FIGS. 4 and 5 is assembled by forming the groove 10 in the pipe or sub 2, 3. The groove 10 is an annular groove of uniform depth which extends about the entire circumference of the pipe or sub 2, 3. The width of the groove 10 is sufficient to receive the block 20. In this embodiment, the block 20 has two semicircular bands 21. The semicircular bands 21 are placed in the groove 10 so that the load bearing flanges 22 of the semicircular bands 21 are on the same side of the groove 10. In other words, the semicircular bands 21 are oriented in the same direction. With the semicircular bands 21 positioned in the groove 10, the lock ring 30 is then translated or moved in the longitudinal direction along the pipe or sub 2, 3 toward the semicircular bands 21. In particular, the lock ring 30 must approach the side of the semicircular bands 21 having ramps 24. The lock ring 30 is urged toward the semicircular bands 21 until the lock flange 32 engages the ramps 24. Because the inside diameter of the lock flange 32 is smaller than the outside diameter of the ramps 24, the lock flange 32 must expand or stretch as the lock ring 30 is further urged toward the block 20. To lock the lock ring 30 to the block 20, the lock ring 30 is further urged toward the block 20 until the lock flange 32 completely moves over the ramps 24. When the ramps 24 have been cleared, the resilient lock flange 32 rebounds or returns to its original size and is retained behind wall 25 of the block 20. When the lock ring 30 is assembled with the block 20, the lock flange 32 engages the wall 25 to prevent the lock ring 30 from being disengaged from the block 20. With the limit clamp 4 completely assembled, the block 20 provides a load bearing surface 28 to engage with rings 5 of dual-ring centralizer 1 (See FIGS. 1–3). Similarly, the lock ring 30 provides a load bearing surface 34 for engagement with ring 5 of dual-ring centralizer 1 (See FIGS. 1–3).

A dual-ring centralizer 1 may be attached to a pipe on site by first cutting a groove 10 in the pipe. A first ring 5 is slid over the end of the pipe 2 until the distal end of the pipe 2 is exposed within the bows 6. The lock ring 30 is then inserted between the bows 6 and slid over the exposed end of the pipe 2. The dual-ring centralizer 1 and the lock ring 30 are further slid down the pipe 2 until the groove 10 is between the rings 5. The block 20 is then inserted into the groove 10 with the ramp(s) 24 toward the lock ring 30. The lock ring 30 is then assembled with the block 20 as described above.

In alternative embodiments of the invention, the groove 10 does not follow a plane which is perpendicular to the longitudinal central axis of the casing. Rather, the groove 10 exists in a plane which is not perpendicular to the longitudinal central axis of the casing so that the groove 10 is elliptical rather than circular. In further embodiments, the groove 10 follows a zig-zag pattern around the circumference of the casing. In other embodiments, of the invention, the groove 10 follows a variety of patterns which provide stops 11 and 12.

Figure 6:
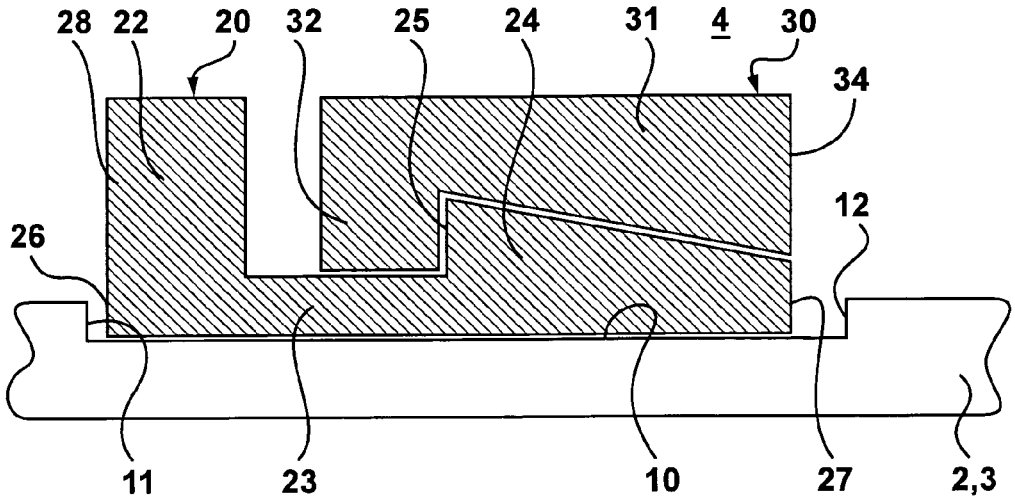
FIG. 6 is a cross-sectional side view of a limit clamp having a block positioned in a groove and a lock ring around the block. The block has a ramp and a load bearing flange. The lock ring has a lock flange.

Referring to FIG. 6, a cross-sectional side view of a limit clamp 4 is shown. Again, an annular groove 10 is cut or formed in the outside surface of a pipe or sub 2, 3. The groove 10 has stops 11 and 12. Block 20 is similar to the block 20 illustrated in FIG. 5. The block 20 has a base 23 with a load bearing flange 22 and a ramp 24 extending radially outward from opposite ends thereof. The ramp 24 has a gradually increasing outside diameter which stops abruptly at wall 25. The block 20 has end walls 26 and 27 for engagement with stops 11 and 12, respectively. The load bearing flange 22 has a load bearing surface 28 for engagement with a dual-ring centralizer 1 or any other well tool (not shown). Lock ring 30 of this embodiment has an annular band 31 with a diameter large enough to extend around the outer circumference of the pipe or sub 2, 3. A lock flange 32 extends from the annular band 31 radially inward toward the pipe or sub 2, 3. The inside surface of the annular band 31 is formed so as to mate firmly with the ramp 24 of the block 20. Further, the lock ring 30 has a load bearing surface 34 at the opposite end from lock flange 32. This limit clamp 4 is assembled similar to the embodiment shown in FIG. 5. The block 20 is positioned in the groove 10 and the lock ring 30 is urged in a longitudinal direction along the pipe or sub 2, 3 toward the ramp 24 of the block 20. Because the inside diameter of the lock flange 32 is smaller than the most extreme height of the ramp 24, the lock flange 32 must stretch or expand as the lock ring 30 is urged over the block 20. When the ramp 24 is cleared, the lock flange 32 snaps behind the ramp 24 to engage wall 25. In this position, the inner surface of the annular band 31 firmly engages the ramp 24.

Figure 7:
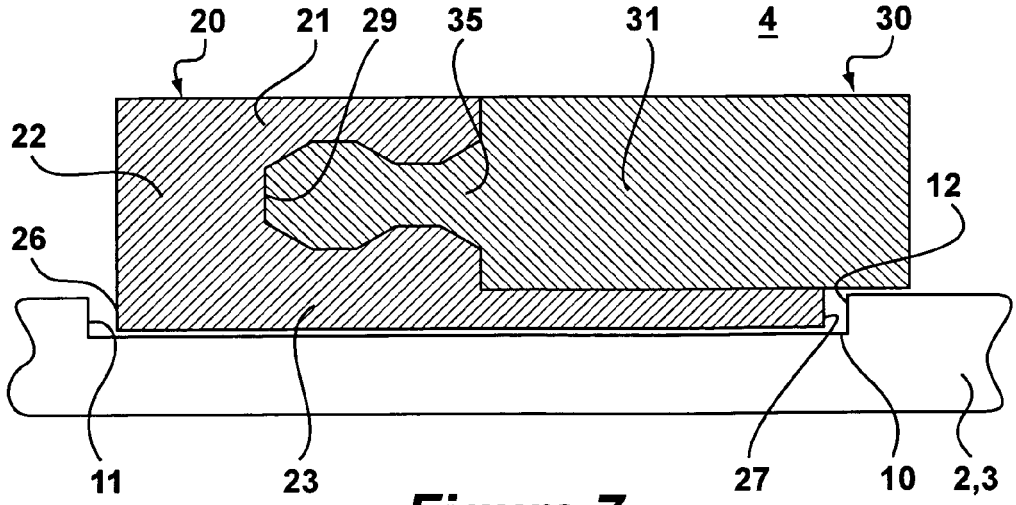
FIG. 7 is a cross-sectional side view of a limit clamp having a block positioned in a groove and a lock ring around the block. The block has a socket and the lock ring has a plug, wherein the socket and plug are mated together.

Referring to FIG. 7, a cross-sectional side view of a limit clamp 4 is shown. A groove 10 is cut or formed in the outer surface of a pipe or sub 2, 3 so as to have stops 11 and 12. Block 20 is comprised of two semicircular bands 21. Each semicircular band 21 has a base 23 which is wide enough to practically fill the groove 10. At opposite ends of the base 23, the block 20 has end walls 26 and 27 which engage the stops 11 and 12 of the groove 10. A load bearing flange 22 extends radially outward from the base 23. The load bearing flange 22 has a socket 29 which has a restriction near its opening. The socket 29 opens in a direct parallel to the longitudinal axis of the pipe or sub 2, 3. The limit clamp 4 also has a lock ring 30 which mates with the block 20. The lock ring 30 has an annular band 31 with an inside diameter only slightly greater than the outside diameter of the base 23 of the block 20. A plug 35 extends from one side of the annular band 31 in a direction parallel to the longitudinal axis of the pipe or sub 2, 3. The plug 35 has a bulbous distal end for mating with the socket 29 of the block 20.

The limit clamp 4 is assembled by forming the groove 10 in the pipe or sub 2, 3. The semicircular bands 21 of the block 20 are positioned within the groove 10 so that they are similarly oriented. The annular lock ring 30 then slides longitudinally along the outer circumference of the pipe or sub 2, 3 until the annular band 31 is positioned about the base 23 of the block 20. The lock ring 30 is locked with the block 20 by mating the plug 35 with the socket 29. Because the socket 29 has a restriction near its opening and the plug 35 has a bulbous distal end, the plug 30 is snapped into the socket 29 and therein retained.

Figure 8:
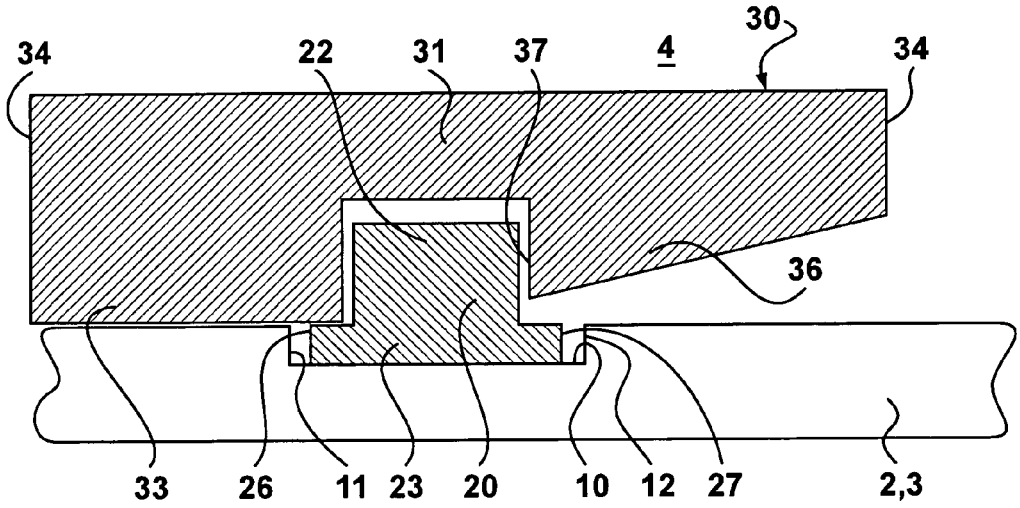
FIG. 8 is a cross-sectional side view of a limit clamp having a block positioned in a groove and a lock ring around the block. The block has a base and a flange. The lock ring has a slide block and a ramp.

FIG. 8 illustrates a limit clamp 4 of the present invention. A groove 10 is formed in the outer surface of a pipe or sub 2, 3. A block 20 is positioned in the groove 10. The block 20 has a base 23 which fits within the groove 10 and a flange 22 extending from the groove 10. The base 23 has end walls 26 and 27 for contact with stops 11 and 12 of the groove 10, respectively. A lock ring 30 is engaged with the block 20. The lock ring 30 has an annular band 31 with both a slide block 33 and a ramp 36 extending radially inward therefrom. The lock ring 30 is assembled to the block 20 by sliding the ramp 36 up and over the flange 22 until the ramp 36 snaps behind the flange 22. The flange 22 is retained behind the ramp 36 by wall 37. Load bearing surfaces 34 are found at opposite ends of the lock ring 30.

Figure 9:
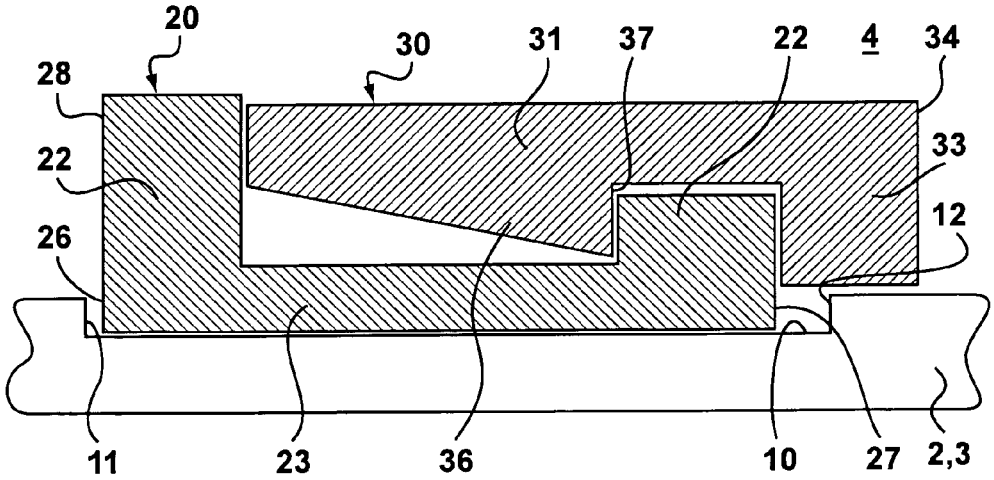
FIG. 9 is a cross-sectional side view of a limit clamp having a block positioned in a groove and a lock ring around the block. The block has a base, a load bearing flange, and a lock flange. The lock ring has a slide block and a ramp.

FIG. 9 shows an alternative limit clamp 4. A groove 10 is formed in the outer surface of a pipe or sub 2, 3. A block 20 is positioned in the groove 10. The block 20 has a base 23 which fits within the groove 10 and two flanges 22 extending from the groove 10. The flanges 22 are at opposite ends of the base 23. The base 23 has end walls 26 and 27 for contact with stops 11 and 12 of the groove 10, respectively. A lock ring 30 is engaged with the block 20. The lock ring 30 has an annular band 31 with both a slide block 33 and a ramp 36 extending radially inward therefrom. The lock ring 30 is assembled to the block 20 by sliding the ramp 36 up and over the flange 22 until the ramp 36 snaps behind the flange 22. The flange 22 is retained behind the ramp 36 by wall 37. In this embodiment, the flange 22 which is not engaged by the lock ring 30 has a load bearing surface 28. The lock ring 30 also has a load bearing surface 34.

Figure 10:
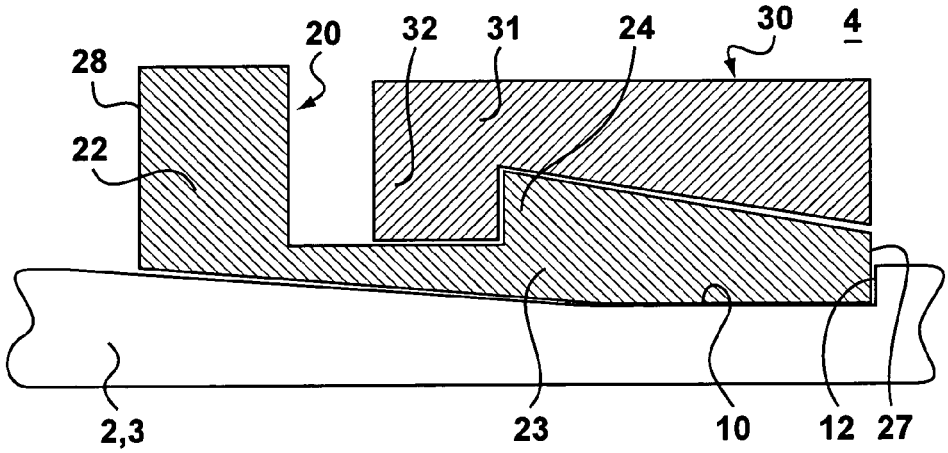
FIG. 10 is a cross-sectional side view of a limit clamp having a block positioned in a groove and a lock ring around the block. The block has a base, a load bearing flange, and a ramp. The lock ring has a lock flange.

A different embodiment of groove 10 is illustrated by FIG. 10. The groove 10 has only one stop 12. The other side of the groove 10 is slanted so that only one stop 12 is provided. This limit clamp 4 may be desired in applications where retention of a dual-ring centralizer 1 is only intended in one longitudinal direction. In other respects, the limit clamp 4 is similar to the embodiment shown in FIG. 6.

Figure 11:
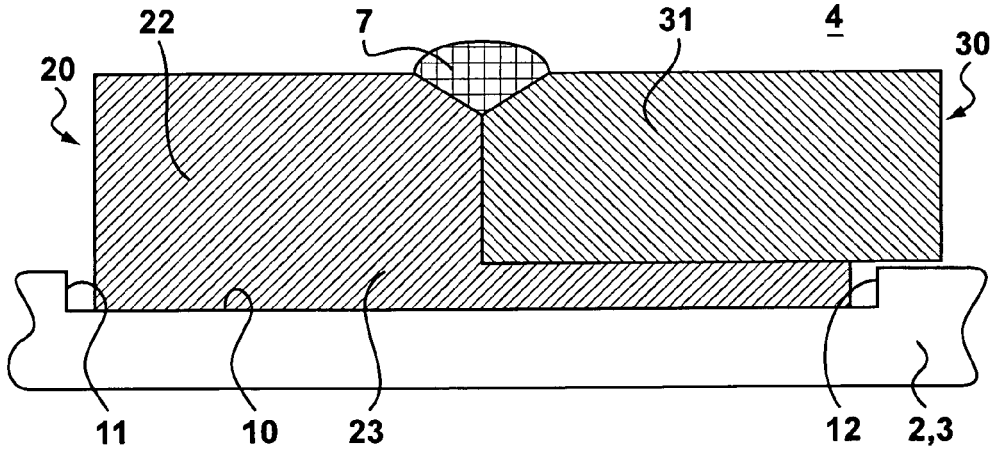
FIG. 11 is a cross-sectional side view of a limit clamp having a block positioned in a groove and a lock ring around the block. The block has a base and a load bearing flange. The lock ring has a slide block. The block and lock ring are welded together.

As shown in FIG. 11, there is an alternative embodiment of a limit clamp 4. A groove 10 is cut or formed in a pipe or sub 2, 3 with stops 11 and 12 at opposite ends. A block 20 is positioned within the groove 10. The block 20 has a base 23 which substantially fills the groove 10. A load bearing flange 22 extends radially outward from the base 23. A lock ring 30 is positioned about the base 23 of the block 20 so as to be immediately adjacent the load bearing flange 22. A butt weld 7 attaches the lock ring 30 to the block 20.

Referring to FIGS. 12A through 12E, an alternative embodiment of a limit clamp 4 is illustrated. This limit clamp 4 has two grooves 10*a* and 10*b* cut or formed in the outer surface of a pipe or sub 2, 3. Both the first groove 10*a* and the second groove 10*b* have stops 11 and 12 at opposite ends of the grooves. A lock ring 30 comprises an annular band 31 with two lock flanges 32*a* and 32*b* extending radially inward at opposite ends.

Figure 12A:
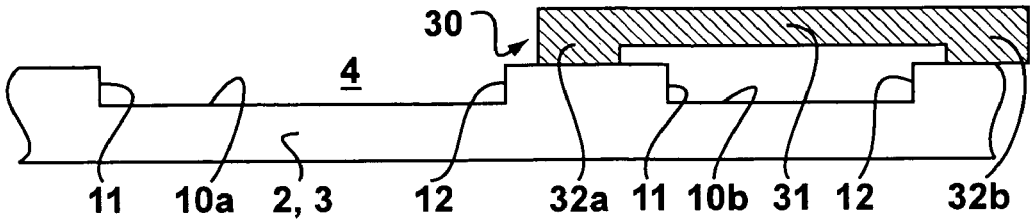
FIG. 12A is a cross-sectional side view of a pipe section with two annular grooves and a lock ring of a limit clamp.
Figure 12B:
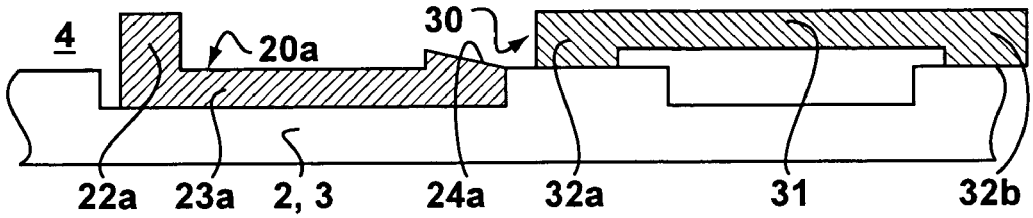
FIG. 12B is a cross-sectional side view of the pipe section shown in FIG. 12A wherein a block is inserted into one of the grooves.
Figure 12C:
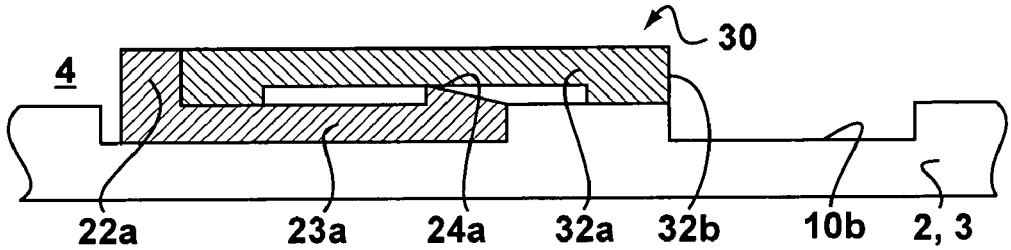
FIG. 12C is a cross-sectional side view of the pipe section shown in FIGS. 12A and 12B, wherein the lock ring is positioned to secure the block.

As shown in FIG. 12B, a first block 20*a* is positioned in the first groove 10*a*. The first block 20*a* has a base 23*a* with a load bearing flange 22*a* extending radially outward therefrom. The load bearing flange 22*a* is at one end of the base 23*a* while a ramp 24*a* is at the other end. As shown in FIG. 12C, the lock ring 30 is slid or translated longitudinally along the pipe or sub 2, 3 so as to slide the lock flange 32*a* up and over the ramp 24*a*. The lock ring 30 is moved toward the first block 20*a* until the lock flange 32*a* is immediately adjacent the load bearing flange 22*a*. With the lock ring 30 in this position, it presents no obstruction to the second groove 10*b*.

Figure 12D:
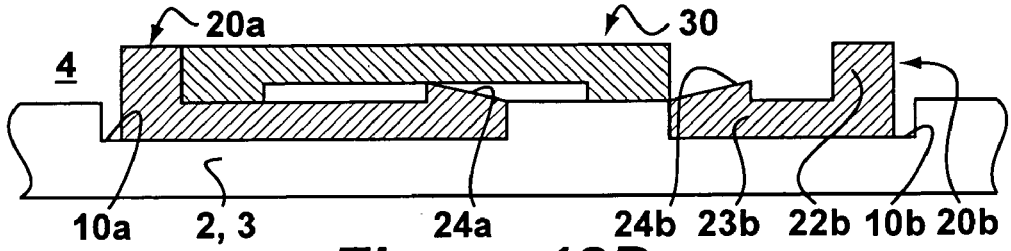
FIG. 12D is a cross-sectional side view of the pipe section shown in FIGS. 12A through 12C, wherein a second block is placed or positioned in the second groove.
Figure 12E:
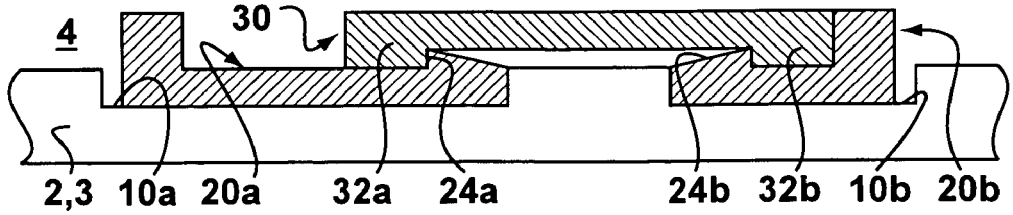
FIG. 12E is a cross-sectional side view of the pipe section shown in FIGS. 12A through 12D, wherein the lock ring is positioned to secure both of the blocks in the grooves.

As shown in FIG. 12D, a second block 20*b* is inserted into the second groove 10*b*. The second block 20*b* has a base 23*b* with a load bearing flange 22*b* and a ramp 24*b* extending from opposite ends in a radial outward direction therefrom. The first and second blocks 20*a* and 20*b* are positioned in the first and second grooves 10*a* and 10*b* so that the ramps 24*a* and 24*b* of both blocks are positioned towards each other. As shown in FIG. 12E, the lock ring 30 is translated in a direction toward the second block 20*b* until the lock flange 32*b* clears the ramp 24*b*. In this position, both first and second blocks 20*a* and 20*b* are secured by the lock ring 30 in the first and second grooves 10*a* and 10*b*, respectively.

Figure 13:
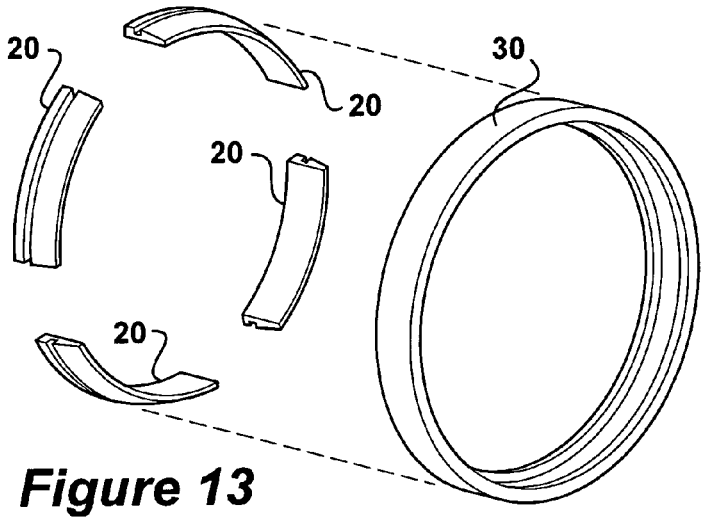
FIG. 13 is an exploded view of four blocks and a lock ring of a limit clamp configuration.
Figure 14A:
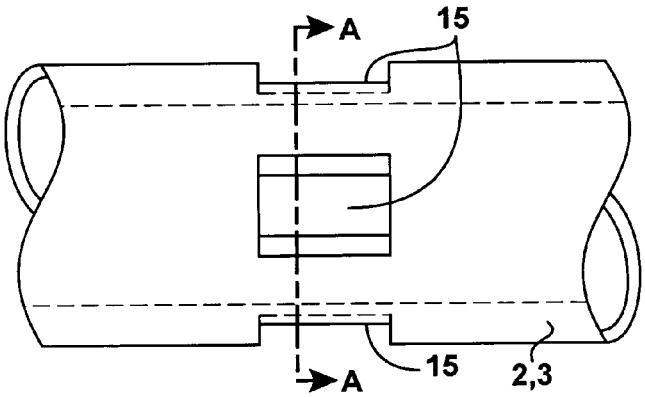
FIG. 14A is a side view of a pipe section having four partial grooves.
Figure 14B:
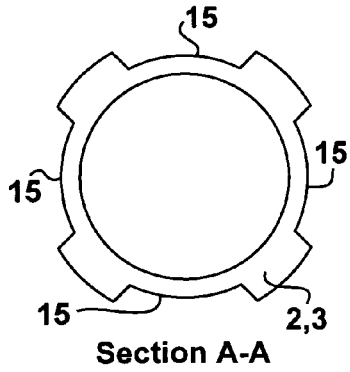
FIG. 14B is a cross-sectional end view of the pipe shown in FIG. 14A, taken along plane A—A.

A further embodiment of a limit clamp 4 is illustrated in FIGS. 13 through 14B. Partial grooves 15 are cut or formed in the outer surface of a pipe or sub 2, 3. Each partial groove 15 extends only a short distance about the circumference. In this case, four partial grooves 15 are formed equidistant from each other around the circumference of the pipe or sub 2, 3. FIG. 14A is a side view of the pipe or sub 2, 3 with the partial grooves 15 formed therein. FIG. 14B is a cross-sectional end view of the pipe or sub 2, 3 taken across plane A—A of FIG. 14A. Blocks 20 shown in FIG. 13 are positioned in the partial grooves 15 around the periphery of the pipe or sub 2, 3. As described above, lock ring 30 is then slid along the pipe or sub 2, 3 to snap onto the blocks 20. This embodiment enables the pipe or sub 2, 3 to endure greater tensile forces because the integrity of the pipe or sub 2, 3 is not compromised by the partial grooves 15 in the area between the partial grooves 15.

Figure 15:
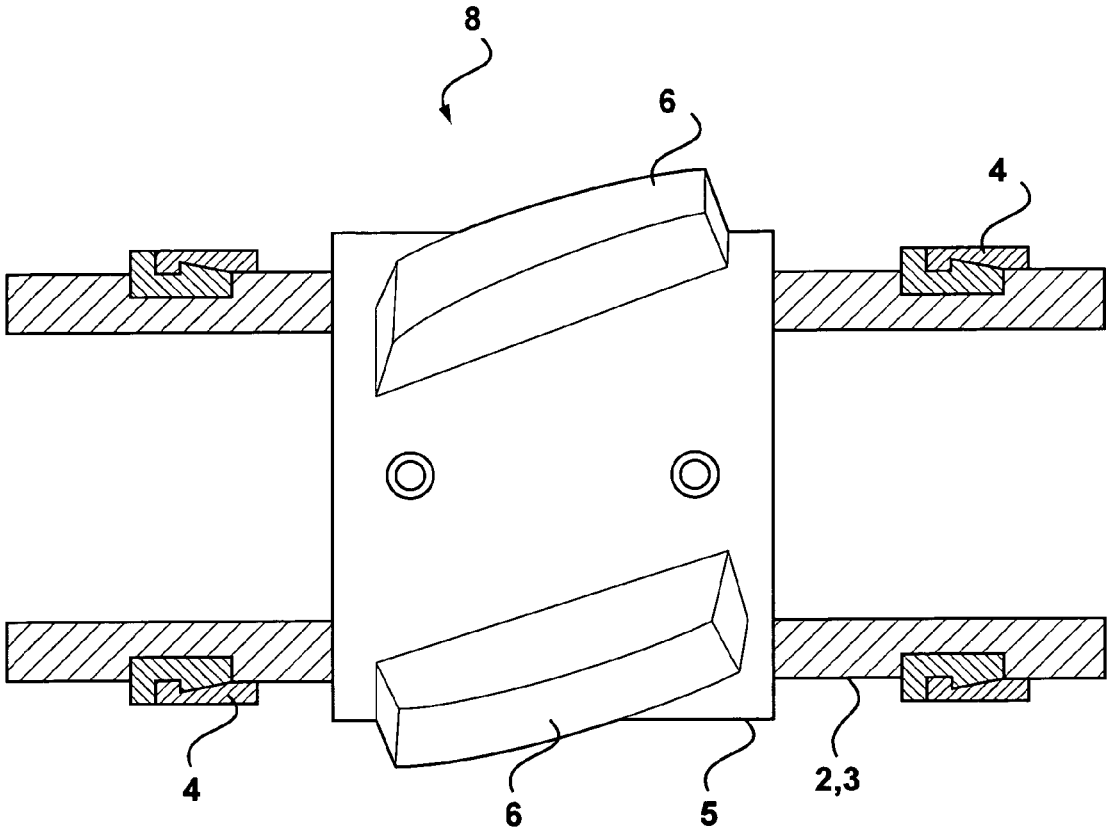
FIG. 15 is a side view of a single-ring centralizer mounted on a pipe or sub between two limit clamps.

Another illustrative embodiment of the invention is shown in FIG. 15. A single-ring centralizer 8 is mounted on a pipe or sub 2, 3 between two limit clamps 4. The limit clamps 4 are secured in grooves in the pipe or sub 2, 3 as described above. Because the single-ring centralizer 8 is between the limit clamps 4, the single-ring centralizer 8 is limited in its range of motion in the longitudinal direction by the limit clamps 4. However, the single-ring centralizer 8 is free to rotate about the pipe or sub 2, 3. The illustrated single-ring centralizer 8 has several rigid bows 6 attached to ring 5.

A dual-ring centralizer 1 may also be mounted to a pipe or sub 2, 3 so that the longitudinal movement of the dual-ring centralizer 1 is limited by two limit clamps 4, rather than just one. One configuration is to place the two limit clamps 4 on the outsides of rings 5. Another configuration is to place one limit clamp 4 between the rings 5 and the other limit clamp 4 outside of one of the rings 5.

Figure 16A:
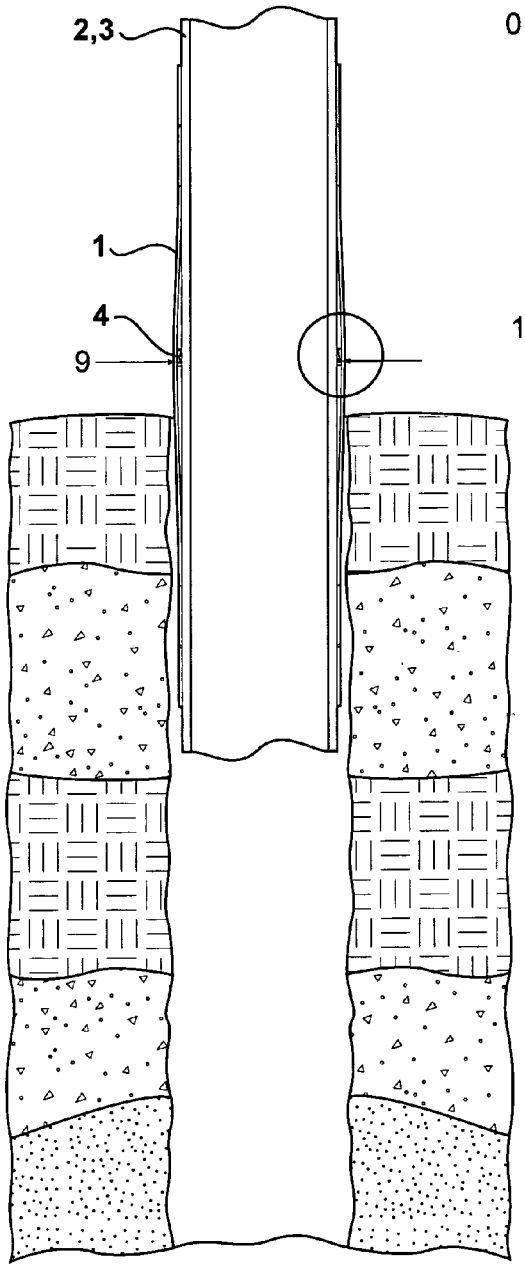
FIG. 16A illustrates a cross-sectional side view of a dual-ring centralizer and limit clamp attached to a pipe being inserted in a wellbore. The relative depth of a groove, and height of a block and lock ring are depicted.
Figure 16B:
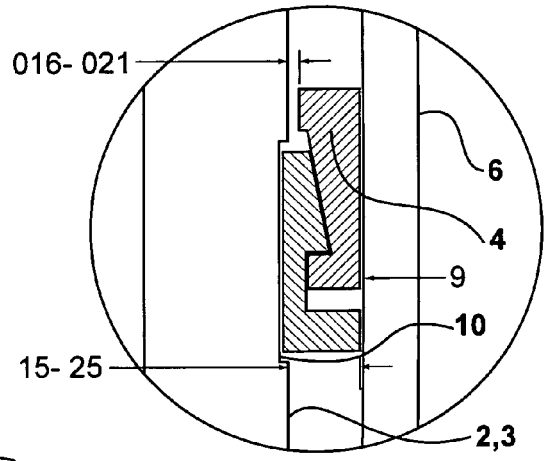
FIG. 16B is an enlarged view of the block and lock ring shown in FIG. 16A.

In some embodiments of the invention, the groove depth is not required to be greater than 0.030 to 0.060 inches (0.0762 to 0.1524 cm) deep. Therefore, the tensile rating would not be decreased when compared to that available with flushline casing connections. In some embodiments of the invention, the limit clamp 4 assembled in the groove 10 extends no more than 0.15 to 0.25 inches (0.381 to 0.635 cm) beyond the outside diameter of the casing. FIGS. 16A and 16B illustrate a cross-sectional side view of the limit clamp 4 relative to a pipe or sub 2, 3 and a bow 6 of a dual-ring centralizer 1.

Embodiments of the invention have the following holding requirements and outside diameters (OD) on the noted pipe sizes when using P-110 material.

4½–25,000 pounds force with a positive OD of 4.80 inches and a 0.017 inch groove depth.

5½–30,000 pounds force with a positive OD of 5.80 inches and a 0.016 inch groove depth.

7–50,000 pounds force with a positive OD of 7.30 inches and a 0.021 inch groove depth.

9⅝–50,000 pounds force with a positive OD of 9.925 inches and a 0.016 inch groove depth. As shown in FIGS. 16A and 16B, outside diameter 9 is identified as the outside diameter of a limit clamp 4 when assembled in a groove 10 in the pipe or sub 2, 3.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of securing a tool to a pipe, the method comprising:

forming a groove in an exterior surface of the pipe, wherein the groove comprises a bottom and at least one stop;

positioning a block in the groove so that a base of the block fits in the groove to contact the at least one stop and a flange of the block extends out of the groove;

locking the block in the groove with a lock ring which encircles the block and the pipe and engages the flange of the block, wherein the locking comprises moving at least a portion of the lock ring over at least a portion of the block, elastically stretching at least a portion of the lock ring as it moves over at least a portion of the block, and then rebounding the stretched portion of the lock ring; and mounting the tool on the pipe so as to be retained by a member of a group consisting of the block and the lock ring.

2. A method as claimed in claim 1, wherein the forming comprises forming an annular groove around the entire circumference of the pipe.

3. A method as claimed in claim 1, wherein the forming comprises forming a groove around only partially around the circumference of the pipe.

4. A method as claimed in claim 1, wherein the forming comprises forming more than one groove, wherein each groove extends entirely around the pipe.

5. A method as claimed in claim 1, wherein the positioning comprises positioning two semicircular bands in a groove.

6. A method as claimed in claim 1, wherein the positioning comprises positioning the block so that a ramp of the block extends from the base out of the groove.

7. A method as claimed in claim 1, wherein the locking comprises engaging a lock flange of the lock ring which extends radially inward from an annular band of the lock ring with the block.

8. A method as claimed in claim 1, wherein the locking comprises engaging a slide block of the lock ring which extends radially inward from an annular band of the lock ring with the pipe.

9. A method as claimed in claim 1, wherein the locking comprises mating a plug and a socket, wherein the plug and socket are in mechanical communication with the block and lock ring.

10. A method as claimed in claim 1, wherein the locking comprises welding the block and lock ring to each other.

11. A limit clamp for securing a tool to pipe, the limit clamp comprising:

a groove in an outer surface of the pipe comprising a bottom and at least one stop, wherein the groove comprises an annular groove extending entirely around the pipe;

a block comprising a base positioned in the groove to contact the at least one stop and a flange which extends out of the groove; and a lock ring encircling the block and the pipe, wherein the lock ring engages the flange of the block.

12. A limit clamp as claimed in claim 11, wherein the groove comprises more than one groove, wherein each groove extends entirely around the pipe.

13. A limit clamp as claimed in claim 11, wherein the groove comprises a groove which extends only partially around the pipe.

14. A limit clamp as claimed in claim 11, wherein the block comprises two semicircular bands.

15. A limit clamp as claimed in claim 11, wherein the block further comprises a ramp extending from the base out of the groove.

16. A limit clamp as claimed in claim 11, wherein the lock ring comprises: an annular band defining a load bearing surface, and a lock flange extending radially inward from the annular band.

17. A limit clamp as claimed in claim 11, wherein the lock ring comprises: an annular band defining a load bearing surface, and a slide block extending radially inward from the annular band.

18. A limit clamp as claimed in claim 11, further comprising a socket and a plug in mechanical communication with the block and lock ring, wherein the plug is matable with the socket.

19. A limit clamp as claimed in claim 11, wherein the block and the lock ring are welded to each other.

20. A centralizer of a pipe within a borehole, the centralizer comprising:

at least one ring larger than the outside diameter of the pipe;

a plurality of bows connected to the at least one ring;

a limit clamp connectable with the pipe for engaging the at least one ring, wherein the limit clamp comprises:

a groove in an outer surface of the pipe comprising a bottom and at least one stop;

a block comprising a base positioned in the groove to contact the at least one stop and a flange which extends out of the groove; and a lock ring encircling the block and the pipe, wherein the lock ring engages the flange of the block, wherein the lock ring comprises:

an annular band defining a load bearing surface, and a lock flange extending radially inward from the annular band.

21. A centralizer as claimed in claim 20, wherein the block comprises two semicircular bands.

22. A centralizer as claimed in claim 20, wherein the block further comprises a ramp extending from the base out of the groove.

23. A centralizer as claimed in claim 20, wherein the lock ring comprises: an annular band defining a load bearing surface, and a slide block extending radially inward from the annular band.

24. A centralizer as claimed in claim 20, wherein the at least one ring comprises two rings connected to each other by the plurality of bows.

25. A centralizer as claimed in claim 24, wherein the limit clamp is between the two rings.

26. A centralizer as claimed in claim 24, wherein the limit clamp is outside of the two rings.

27. A centralizer as claimed in claim 20, wherein the plurality of bows are rigid.

28. A centralizer as claimed in claim 20, wherein the plurality of bows are spring bows.

29. A centralizer as claimed in claim 20, further comprising a second limit clamp, wherein the limit clamps are connectable with the pipe with the at least one ring between the limit clamps.

30. A centralizer sub comprising:

a base pipe;

a groove in an exterior surface of the base pipe, wherein the groove comprises a bottom and at least one stop;

a block comprising a base which fits in the groove to contact the at least one stop and a flange which extends out of the groove;

a lock ring encircling the block and the base pipe and engaging the flange of the block, wherein the lock ring comprises an annular band and a ramp extending radially inward from the annular band; and a centralizer mounted to the base pipe and retained by a member of a group consisting of the block and the lock ring.

31. A centralizer sub as claimed in claim 30, wherein the base pipe has male and female threads on opposite ends, respectively.

32. A centralizer sub as claimed in claim 30, wherein the block comprises two semicircular bands, each band comprising a ramp extending from the base out of the groove, and wherein the lock ring comprises: an annular band defining a load bearing surface, and a lock flange extending radially inward from the annular band.

33. A centralizer sub as claimed in claim 30, wherein the centralizer comprises two rings connected to each other by the plurality of bows.

34. A centralizer sub as claimed in claim 33, wherein the block and lock ring are between the two rings.

35. A centralizer sub as claimed in claim 33, wherein the block and lock ring are outside of the two rings.

36. A centralizer sub as claimed in claim 33, wherein the plurality of bows are rigid.

37. A centralizer sub as claimed in claim 33, wherein the plurality of bows are spring bows.

38. A centralizer sub as claimed in claim 33, further comprising a a second groove in an exterior surface of the base pipe, wherein the second groove comprises a bottom and at least one stop;

a second block comprising a base which fits in the second groove to contact the at least one stop and a flange which extends out of the second groove;

a second lock ring encircling the second block and the base pipe and engaging the flange of the second block, wherein at least one ring of the centralizer is mounted to the base pipe between the groove and the second groove.

* * * * *